US005734309A

United States Patent [19]

Schmitz

[11] Patent Number: 5,734,309

[45] Date of Patent: Mar. 31, 1998

[54] ENERGY-SAVING ELECTROMAGNETIC SWITCHING ARRANGEMENT

[75] Inventor: Günter Schmitz, Aachen, Germany

[73] Assignee: FEV Motorentechnik GmbH & Co. KG, Aachen, Germany

[21] Appl. No.: 660,103

[22] Filed: Jun. 7, 1996

[30] Foreign Application Priority Data

Jun. 9, 1995 [DE] Germany ..... 195 21 078.6

[51] Int. Cl.[6] ..... H01H 9/00

[52] U.S. Cl. ..... 335/177; 335/179

[58] Field of Search ..... 335/177–179

[56] References Cited

U.S. PATENT DOCUMENTS

| | | | |
|---|---|---|---|
| 3,715,694 | 2/1973 | Kruger | 335/177 |
| 5,339,777 | 8/1994 | Cannon | 123/90.12 |
| 5,379,014 | 1/1995 | Sato et al. | 335/177 |

FOREIGN PATENT DOCUMENTS

| | | |
|---|---|---|
| 2063158 | 6/1972 | Germany . |
| 3923477A1 | 1/1991 | Germany . |

*Primary Examiner*—Lincoln Donovan
*Attorney, Agent, or Firm*—Spencer & Frank

[57] ABSTRACT

An electromagnetic switching arrangement for operating a control device, with the arrangement having two electromagnets (1, 2) which are formed respectively from a coil (3.1, 3.2) and a magnetic yoke (4.1, 4.2), are connected to an actuatable direct-current supply (9), and are spaced from one another, with the pole faces (5) of the two magnet yokes (4.1, 4.2) facing one another. An armature (6) is disposed between the two electromagnets so that the armature can move back and forth between the pole faces (5) of the two electromagnets. The armature (6) is connected to the control device to be operated and is held by spring elements (8.1, 8.2) in an inoperative or neutral position between the two electromagnets (1, 2) when both electromagnets are currentless. At least the armature (6) is made of a material that contains a residual magnetization.

3 Claims, 1 Drawing Sheet

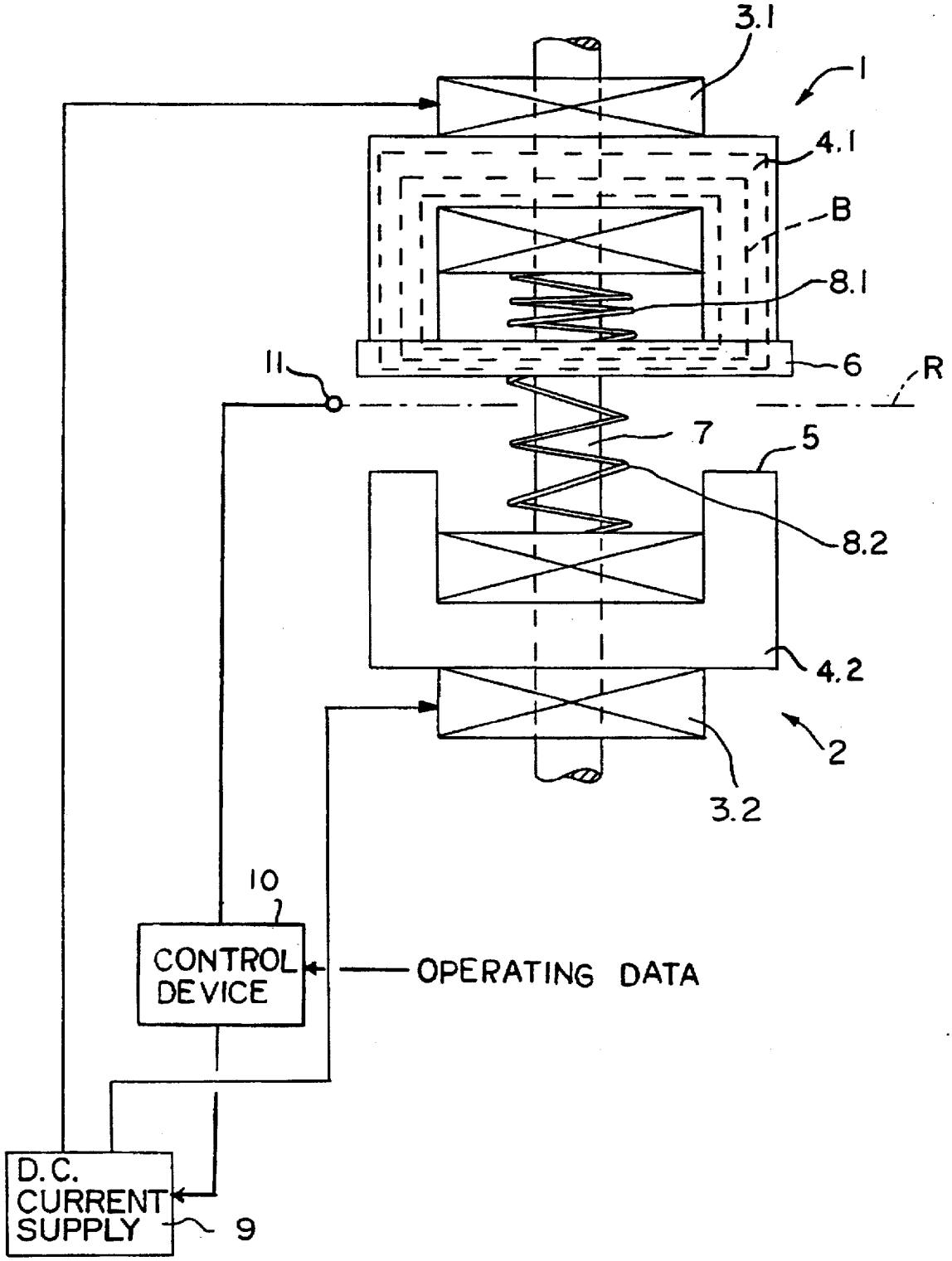
3.1
1
4.1
B
8.1
6
R
11
7
5
8.2
4.2
2
3.2
10
CONTROL DEVICE
OPERATING DATA
D.C. CURRENT SUPPLY
9

ENERGY-SAVING ELECTROMAGNETIC SWITCHING ARRANGEMENT

REFERENCE TO RELATED APPLICATIONS

This application claims the priority of German Patent Application Serial No. DE 19521078.6, filed Jun. 9, 1995, which is incorporated herein by reference.

BACKGROUND OF THE INVENTION

The present invention related to an electromagnetic switching arrangement of the type including a pair of electromagnets which are selectively energized to control the position of a common armature.

Electromagnetic switching arrangements for operating control devices, for example for operating gas-exchange valves, i.e., the cylinder valves, in internal combustion engines, are often required to achieve high switching speeds and, at the same time, large switching forces. A switching arrangement of this type is illustrated and described in, for example, German Patent Application DE-A 20 63 158. In this arrangement, when the electromagnets are without current, the armature is held by spring elements in an inoperative or neutral position between the two pole faces of the electromagnets, whereas during operation the armature alternatingly rests against the pole faces of one or the other electromagnet. In gas-exchange valves, this resting position against the pole faces of one of the electromagnets corresponds to the open or closed position, respectively, of the gas-exchange valve. To operate the gas-exchange valve, for example, to move it out of the closed position into the open position or vice versa, the holding current supplied to the respective coil is shut off. Consequently, the holding force of the electromagnet against the spring force ceases, and the armature begins to move, accelerated by the spring force. After the armature has passed through its inoperative (neutral) position, the movement of the armature is slowed by the spring force of the oppositely-located spring element. Now, in order to capture and hold the armature in the other position, the coil of the other electromagnet is supplied with current. This capturing process requires relatively high energies that particularly lead to relatively high power draws at high engine rpms, and thus to an increase in fuel consumption.

Attempts have been made to decrease the electrical energy required for operation, as described in, for example, German Patent Application DE-A 39 23 477. In this case it is proposed to lower the current or keep it constant in order to achieve a reduction in the electrical power to be applied by the electrical system prior to the anticipated impact of the armature on the pole face. The actual amount of magnetic excitation required, that is, the primary cause of current consumption, cannot be reduced with this solution.

It is therefore an object of the invention to reduce the magnetic excitation required for the switching arrangement of the type discussed above.

SUMMARY OF THE INVENTION

The above object generally is achieved according to the present invention by an electromagnetic switching arrangement for operating a control device, which arrangement includes: two electromagnets each formed from a respective coil and a respective magnetic yoke, with the two electromagnets being spaced from one another with the pole faces of the two magnetic yokes facing each other, and with the two coils being connected to an actuatable direct-current supply; and a common armature which can move back and forth between the two pole faces, which is connected to the control device to be operated, and which is held in an inoperative or neutral position between the two electromagnets when they are currentless by respective spring elements; and wherein at least the armature is made of a material that contains a residual magnetization.

Because the armature has a residual induction, which is caused by, for example, its magnetization at the one electromagnet, during operation involving an approach toward the other electromagnet, the magnetic field which is established there for the purpose of attraction or capture of the armature is intensified so that the magnetic excitation in the coil can be reduced in comparison with the excitation required when using an armature having no residual induction, or having false residual induction or residual induction oriented in the opposite direction. The residual magnetization also has a positive effect on the electrical power required for holding the armature, because the necessary currents can also be greatly reduced in this instance. The limit for the maximum allowed residual induction results from the value that makes it possible to hold the armature at one of the electromagnets without supplying current to that electromagnet. It is useful, however, if the armature material is selected such that an adhesive force acting between the armature and an electromagnet pole face due to the residual magnetization with a currentless electromagnet is less than the restoring force of the respectively tensed or compressed spring element. This ensures that the spring reliably moves the armature, and thus the control member in the opposite direction, when the holding electromagnet is set to be currentless. With higher values of the residual induction, the only remaining possibility is that of throwing off the armature again through the build-up of a countermagnetic field, that is, through the supply of a current oriented opposite that used for the capturing process. This would either require reversing the current flow, with corresponding delays due to the build-up of the opposing field, or the arrangement of an additional electromagnet which would then be supplied with current in order to generate the countermagnetic field. This is, however, only possible in practice if the exchange for the control member is effected at low frequency or a sufficient structural space is provided to accommodate this type of additional "dumping magnet."

It is particularly useful if the current flow-through of the coils of the two electromagnets during operation is oriented such that the polarity of the residual field of the armature remains in the same direction. If the magnetic excitation generated in this manner in the armature is effective in the same direction as the residual induction remaining in the armature, a smaller current supply to the coil of the capturing electromagnet suffices to generate the magnetic field necessary for reliable capture of the armature. A reversed polarization of the coils would either make capture impossible because of the opposite direction of the magnetic fields if the current were unchanged, or necessitate a significantly higher current for capture.

In a further, preferred embodiment of the invention, at least one sensor is provided for detecting armature movement, the sensor being connected to the device for actuating the direct-current supply of the respective electromagnet coils. The presence of the residual induction in the armature has the disadvantage that the armature "sticks" to the pole face of the respective holding electromagnet after the electromagnet has been set to be currentless, so the release of the armature under the effect of the force of the spring element which is then tensed does not necessarily coincide with the shutoff of the current flow through the coil of the holding electromagnet. If at least one sensor which is connected to the actuation of the direct-current supply is associated with the path of movement of the armature, the possibility exists of influencing the time of shutoff of the holding current. If the time of armature release is predetermined by a corresponding control device, the desired time at which the armature must move past the sensor(s) is also determined. If the sensor determines that the passage is too early in comparison to the desired time, for the next work cycle, the time for currentless setting of the armature is correspondingly moved back. This ensures that the "sticking" of the armature to the respective holding magnet used for purposeful reduction of energy consumption can be reliably corrected.

If two sensors are associated with the path of movement of the armature, the speed of movement of the armature can be detected via signals detected consecutively by the two sensors over time, independently of the respective shutoff time of the holding current, and both the shutoff of the holding current and the turning on of the capturing current can be determined precisely with respect to time.

BRIEF DESCRIPTION OF THE DRAWINGS

The invention is described in detail in conjunction with the Figure which is a schematic drawing of an embodiment of the control arrangement according to the invention.

DETAILED DESCRIPTION OF THE PREFERRED EMBODIMENT

The illustrated switching arrangement essentially comprises an electromagnet 1 and an electromagnet 2, which each essentially comprises a respective coil 3.1 or 3.2 and a respective u-shaped magnetic yoke 4.1 or 4.2. The two electromagnets 1 and 2 are spaced from one another, with their pole faces 5 facing each other.

Disposed between the pole faces 5 of the two electromagnets 1 and 2 is an armature 6, which is connected to an eccentric or slide rod 7 connected to the device to be operated, for example, a gas-exchange or motor cylinder valve. When the electromagnets 1 and 2 are both currentless, the armature 6 is held in its inoperative or neutral position between the two electromagnets 1 and 2 by two spring elements 8.1 and 8.2, respectively, which as shown are disposed around the rod 7 and between the respective magnetic yoke 4.1 or 4.2 and the armature 6. If the coil 3.1 of the electromagnet 1 is charged by current, the armature 6 is attracted and comes in contact with the pole faces 5 of the magnetic yoke 4.1. The spring element 8.1 is correspondingly pre-tensed or compressed. In the illustrated position of the armature 6, the current flowing through the coil 3.1 causes a magnetic field B to flow through the armature 6. If the current flow through the coil 3.1 is now shut off, the magnetic excitation caused by the current drops to zero. If, as provided in accordance with the invention, the armature 6 is produced from a material that contains a residual induction, a magnetic residual induction remains in the armature 6 due to hysteresis effects. The larger the hysteresis loop of the armature material, the greater the residual magnetization. With hard-magnetic material, this residual magnetization is correspondingly high.

The inoperative or neutral position of the armature 6 is indicated by the dot-dash line R.

If the armature material on the one hand and the spring elements 8 on the other hand are selected such that the remaining residual magnetization, and therefore the magnetic force acting between the armature 6 and the magnet yoke 4.1, lies below the value necessary to secure the armature 6 counter to the force of the compressed element 8.1, the armature 6 begins to detach from the magnetic yoke 4.1. The armature 6 is accelerated by the compressed spring element 8.1 until the armature 6 passes through the neutral or inoperative position R. Thereafter, the spring element 8.2 on the opposite side again begins to compress and to slow the movement of the armature 6. Depending on the frictional losses, the armature 6 would not reach the pole face 5 of the electromagnet 2 on the opposite side if no additional magnetic force were applied to the armature 6 by the electromagnet 2. To generate this magnetic force, a magnetic excitation must be produced in the electromagnet 2 by supplying a current to the coil 3.2. If the magnetic excitation produced in the armature 6 by the electromagnet 2 acts at least partly in the same direction as the residual magnetization remaining in the armature 6, a lower current supply to the coil 3.2 of the electromagnet 2 suffices to generate the magnetic field necessary for reliable capture of the armature 6 by the electromagnet 2.

The coils 3.1 and 3.2 of the electromagnets 1 and 2 are connected to a direct-current supply 9. The current flow through the coils 3.1 and 3.2 is oriented such that surfaces located opposite one another have a like polarization during flow-through of the coils by a current.

The direct-current supply 9 is actuated by a control device 10 to correspond to a predetermined operating program. The operating data, for example rpm, load status, etc., in an internal combustion engine, are entered by way of the engine electronics.

A sensor 11 associated with the path of movement of the armature 6 can further be connected to the control device 10, for example, at the height of the inoperative or neutral position of the armature 6 between the two electromagnets 1 and 2. In this instance, when the armature passes the sensor 11, a corresponding signal is generated which, inside the control device 10, permits determination of whether the actual time of the passage determined by way of the sensor 11 matches the desired time predetermined by the control, so that corresponding deviations in actuation times for current supply to the coils of the holding magnets 1 and 2 can be corrected. The residual induction of the armature 6 can be put to good use for sensor detection in the use of a sensor operating on the basis of magnetic principles. As a material with sufficient residual induction the steel St 37 can be taken. However, depending on the actual design of the magnets and the spring forces other materials are suitable.

The invention now being fully described, it will be apparent to one of ordinary skill in the art that any changes and modifications can be made thereto without departing from the spirit or scope of the invention as set forth herein.

What is claimed:

1. An electromagnetic switching arrangement for operating a control device, said arrangement comprising:

two electromagnets, each formed from a respective coil disposed on a respective magnetic yoke, said two electromagnets being spaced from one another with the pole faces of the two magnetic yokes facing each other; an actuatable direct-current supply connected to said coils of said two electromagnets for alternatingly supplying current to said coils; an armature which is disposed between and moveable back and forth between said pole faces of said electromagnets and which is connected to the control device to be operated; and, a respective spring element, disposed between said armature and each of said magnetic yokes, for exerting a restoring force on said armature to hold said armature in an inoperative (neutral) position between the two electromagnets when said electromagnets are currentless; and wherein at least said armature is made of a material that contains a residual magnetization, and said coils are connected to said direct current supply so that current flowing through said coils of said two electromagnets is oriented such that the polarity of the residual field of said armature remains in the same direction.

2. A switching arrangement as defined in claim 1, wherein said armature material is configured such that an adhesive force, which acts between the armature and a pole face of a respective magnetic yoke due to said residual magnetization, when the respective electromagnet is currentless, is less than the restoring force of the respectively compressed spring element.

3. A switching arrangement as defined in claim 1, further comprising at least one sensor for sensing movement of said armature with said sensor being connected to a device for actuating said direct-current supply for said coils of said electromagnets.

* * * * *